United States Patent [19]

Arvisenet

[11] 4,302,644

[45] Nov. 24, 1981

[54] CONTACT BREAKER WITH MAGNETIC ARC BLOWING

[75] Inventor: Jacques Arvisenet, La Celle St. Cloud, France

[73] Assignee: La Telemecanique Electrique, France

[21] Appl. No.: 971,168

[22] Filed: Dec. 20, 1978

Related U.S. Application Data

[63] Continuation of Ser. No. 782,606, Mar. 29, 1977.

[51] Int. Cl.[3] ..... H01N 33/18
[52] U.S. Cl. ..... 200/147 R
[58] Field of Search ..... 200/147 R

[56] References Cited

U.S. PATENT DOCUMENTS

| | | | |
|---|---|---|---|
| 1,533,251 | 4/1925 | Johnston | 200/147 R |
| 1,763,116 | 6/1930 | White | 200/147 R |
| 2,090,519 | 8/1937 | Rankin | 200/147 R |
| 2,150,564 | 3/1939 | Rowe | 200/147 R |

*Primary Examiner*—Robert S. Macon
*Attorney, Agent, or Firm*—William A. Drucker

[57] ABSTRACT

An electrical contact breaker has a stationary contact, and a movable contact. The movable contact is connected to a terminal by a flexible conductor. For blowing out the arc formed when the contacts separate under load, there is a blowing means including a winding traversed by the current, and pole pieces directing the magnetic field of the winding to the vicinity of the arc gap. The improvement is that the winding is constituted by at least part of the flexible conductor.

2 Claims, 2 Drawing Figures

CONTACT BREAKER WITH MAGNETIC ARC BLOWING

This is a continuation of Ser. No. 782,606 filed Mar. 29, 1977.

BACKGROUND OF THE INVENTION

The invention relates to a contact breaker, for the interruption of electric currents, comprising a fixed contact cooperating with a movable contact coupled to a terminal by a flexible conductor, and a magnetic blowing means constituted by a winding which is traversed by the current of the contact breaker and of which the magnetic field is guided by pole pieces to the vicinity of the breaking zone.

Such contact breakers are particularly used for the breaking of heavy currents, and hitherto the blowing winding was constituted by several turns of a heavy conductor placed adjacent to the fixed contact.

The winding of the conductor becomes increasingly critical as its section became greater in order to be able to carry the heavy currents. In practice it is not possible to give the turns an internal diameter as small as is desirable, and there are large losses between the winding and the associated pole pieces. The mounting of the winding, generally of large dimensions, requires bulky mounting means which result in disadvantageous arrangement of the breaking chamber. There must also be added the cost of a flexible conductor.

OBJECT OF THE INVENTION

The object of the invention is to provide an improved construction which eliminates the inconveniences of the known devices.

SUMMARY OF THE INVENTION

According to the invention this result is achieved in that the winding is constructed with a flexible conductor which serves simultaneously to couple the movable contact, fast with an insulating contact carrier, to the corresponding terminal.

Other features of the invention will be apparent from the following description with reference to the accompanying drawings.

DESCRIPTION OF THE PREFERRED EMBODIMENTS

Figure 1:
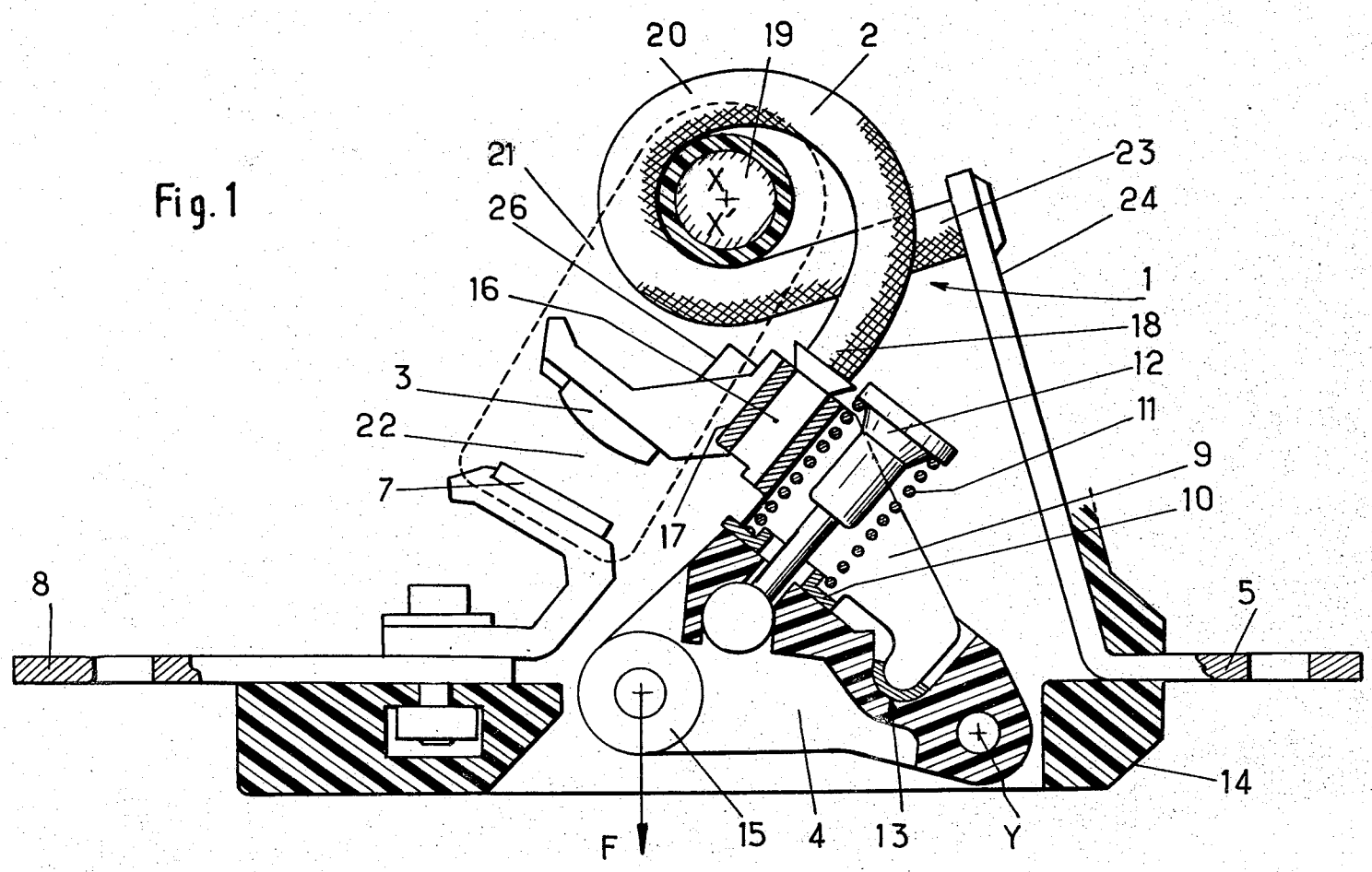
FIG. 1 is a view in elevation of a contact breaker.

The contact breaker shown in FIG. 1 comprises a fixed contact 7 made fast with a first coupling terminal 8 of a casing. With the contact 7 there cooperates a movable contact 3 secured on a lever 9 capable of pivoting on a bearing surface 13 formed in a contact carrier of insulating material, the carrier being itself capable of pivoting about a fixed axis YY' fast to the casing 14, of which only a portion has been shown.

The contact carrier has a boss 15 intended for coupling with the movable part of an electromagnet (not shown) or with that of any other driving member, for example a pneumatic ram, the direction of contact-closing operation of which is indicated by the arrow F.

A pivotable bolt 12 engaged movably in the contact carrier 4 bears against one end of a helicoidal compression spring 11, the other end of which spring bears on a cross member 10 of the lever 9 in order to provide the contact pressure during closing.

A conductive portion 17, fast with the movable contact 3, or with the lever 9 which is metallic, or again which is disposed between these two elements in order to be held by a bolt 26, comprises at least one opening, such as 16, receiving a first end 18 of a flexible braid 2, made of copper, forming a turn 20 the central axis XX' of which is placed above and in the vicinity of the movable contact when the latter is open. This axis is common to a cylindrical magnetic core 19 which is fast with magnetic flange plates of which one, 21, is shown in chain-dotted line and which extends as far as the arcing zone 22, the second flange plate 25 being visible in FIG. 2.

The second end 23 of the braid 2 is made mechanically and electrically integral with a bracket 24 which is an extension of the second coupling terminal 5 as shown or which can be coupled thereto.

This braid 2 thus fulfills simultaneously the functions of electrical connection of the movable contact and of the winding for the magnetic blowing of the arc.

Figure 2:
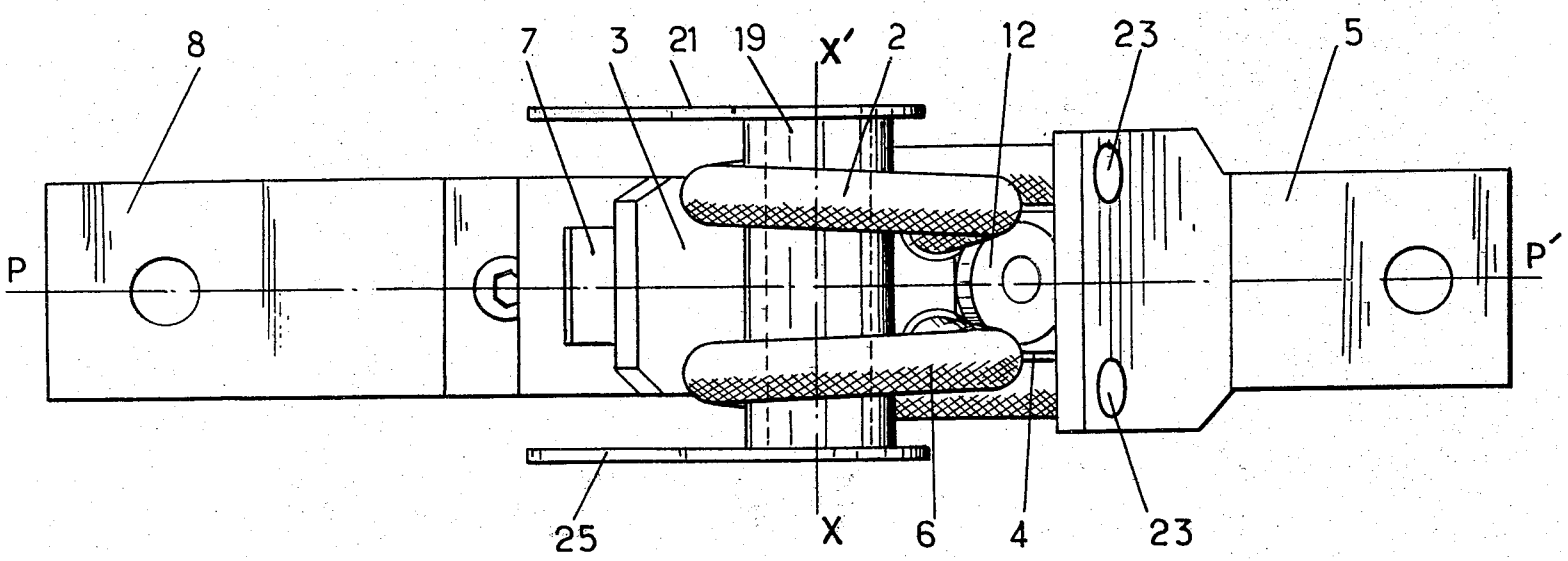
FIG. 2 is a corresponding plan view.

In FIG. 2 this first braid 2 is seen to be placed in parallel with a second braid 6 which is symmetrical with the former about the plane PP', which is perpendicular to the plane of the figure and which constitutes the plane of displacement of the movable contact during closing and opening.

I claim:

1. A contact breaker with magnetic arc blowing for the interruption of an electrical current, said contact breaker comprising: a fixed contact; an insulating pivoting contact carrier having first and second surface portions; a conducting support lever pivoting on the first surface portion of said pivoting contact carrier; resilient means engaging the conducting lever and the second surface portion of said pivoting contact carrier for resiliently mounting the conducting lever to the contact carrier; a movable contact supported by said pivoting conducting lever; first and second terminals; said fixed contact being connected to said first terminal; magnetic blowing means comprising a flexible coil means consisting of a single conducting braid; a magnetic core within said flexible coil; pole pieces fast with said magnetic core and arranged for guiding, up to the breaking zone, the magnetic field generated by said flexible coils; said flexible coil having a first end electrically connected to the conducting lever in close proximity to the movable contact and a second end mechanically and electrically connected to said second terminal.

2. A contact breaker according to claim 1, wherein said movable contact is mounted for rotatory movement in a plane and the flexible coil means includes two conducting braids which are symmetrically arranged with respect to the said plane, said two conductors being wound about a fixed axis which is located in the vicinity of the movable contact in the open position of the contact breaker.

* * * * *